US006750743B1

(12) United States Patent
Subramanian et al.

(10) Patent No.: US 6,750,743 B1
(45) Date of Patent: Jun. 15, 2004

(54) INTEGRATED THERMAL AND MAGNETIC TRIP UNIT

(75) Inventors: Anantharam Subramanian, Secunderabad (IN); Ronald Ciarcia, Bristol, CT (US); Luis A. Brignoni, Vega Alta, PR (US); Narender Macha, Hyderabad (IN); Navin Kumar, Karnataka (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/436,619

(22) Filed: May 13, 2003

(51) Int. Cl.[7] ..... H01H 73/66; H01H 71/40; H01H 9/02

(52) U.S. Cl. ..... 335/8; 200/306; 218/157; 335/35; 335/172; 337/47

(58) Field of Search ..... 335/6–8, 16, 21–25, 335/35, 132, 135, 137, 147, 165, 166, 172, 195, 196, 202; 200/306; 218/22, 35, 157; 337/8, 40–47, 110

(56) References Cited

U.S. PATENT DOCUMENTS 3,631,369 A * 12/1971 Menocal ..... 337/110
5,103,198 A * 4/1992 Morel et al. ..... 335/6
6,188,036 B1 * 2/2001 Arnold ..... 218/157
6,218,919 B1 4/2001 Ciarcia et al. ..... 335/167

* cited by examiner

*Primary Examiner*—James R. Scott
(74) *Attorney, Agent, or Firm*—Cantor Colburn LLP

(57) ABSTRACT

A circuit breaker for a multi-pole electrical distribution circuit includes a cassette associated with each pole in the multi-pole electrical distribution circuit. Each cassette includes a housing, a pair of electrical contacts disposed in the housing, and a thermal and magnetic trip unit supported by the housing. The housing includes a first compartment having the electrical contacts disposed therein and a second compartment having at least a portion of the thermal and magnetic trip unit disposed therein. A wall separates the first and second compartments for isolating the second compartment from gasses generated by separation of the first and second contacts. A duct adjacent to the second compartment allows the gasses to pass to an exterior portion of the housing. The housing includes a pair of opposing slots formed therein for receiving edges of a load terminal. A lever has a first end disposed proximate an end of a bimetallic element and a second end disposed proximate an armature in the magnetic assembly of the trip unit. The lever is rotated by at least one of the bimetallic element and the armature to unlatch an operating mechanism.

19 Claims, 9 Drawing Sheets

INTEGRATED THERMAL AND MAGNETIC TRIP UNIT

BACKGROUND OF THE INVENTION

The present invention relates to circuit breakers and, more particularly, to circuit breakers including thermal and magnetic trip units.

Circuit breakers typically provide instantaneous, short time, and long-time protection against high currents produced by various conditions such as short-circuits, ground faults, overloads, etc. In a circuit breaker, a trip unit is the device that senses current (or other electrical condition) in the protected circuit and responds to high current conditions by tripping (unlatching) the circuit breaker's operating mechanism, which in turn separates the circuit breaker's main current-carrying contacts to stop the flow of electrical current to the protected circuit. Such trip units are required to meet certain standards, e.g., UL/ANSI/IEC, which define trip time curves specifying under what conditions a trip must occur, i.e., short time, long time, instantaneous, or ground fault, all of which are well known.

One type of trip unit is known as a thermal and magnetic trip unit. A thermal and magnetic trip unit includes a magnetic assembly and a thermal assembly. The thermal assembly typically includes a bimetallic element through which electrical current flows. As current flows through the bimetallic element, the bimetallic element heats up and bends due to the different coefficients of expansion in the metals used to form the bimetallic element. If the temperature rise is sufficient, the bimetallic element bends enough to move an associated trip latch, which unlatches the operating mechanism to separate the main current-carrying contacts. The thermal assembly is typically used to sense an overload condition.

The magnetic assembly typically includes a magnet core (yoke) disposed about a current carrying strap, an armature (lever) pivotally disposed near the core, and a spring arranged to bias the armature away from the magnet core. Upon the occurrence of a short circuit condition, very high currents pass through the strap. The increased current causes an increase in the magnetic field about the magnet core. The magnetic field acts to rapidly draw the armature towards the magnet core, against the bias of the spring. As the armature moves towards the core, the end of the armature moves an associated trip latch, which unlatches the operating mechanism causing the main current-carrying contacts to separate.

Thermal and magnetic trip units must be calibrated to ensure that the circuit breaker trips at the appropriate current conditions. Calibration typically includes adjusting a distance between the bimetal and its associated trip latch and between the armature and its associated trip latch. However, establishing and maintaining calibration can be made difficult due to relative motion of the operating mechanism and the trip unit.

BRIEF SUMMARY OF THE INVENTION

The above discussed and other drawbacks and deficiencies are overcome or alleviated by a circuit breaker for a multi-pole electrical distribution circuit, the circuit breaker including a cassette associated with each pole in the multi-pole electrical distribution circuit. Each cassette includes a housing, a pair of electrical contacts disposed in the housing, and a thermal and magnetic trip unit supported by the housing. The thermal and magnetic trip unit initiates separation of the pair of electrical contacts in response to an overcurrent condition in the multi-pole electrical distribution circuit.

In one embodiment, the housing includes a first compartment having the pair of electrical contacts disposed therein and a second compartment having at least a portion of the thermal and magnetic trip unit disposed therein. The first and second compartments have a wall disposed therebetween for isolating the second compartment from gasses generated by separation of the pair of electrical contacts. The first compartment may be in fluid communication with an exterior portion of the housing through a duct adjacent the second compartment, such that the gasses pass through the channel to the exterior portion of the housing.

In another embodiment, an end of the housing includes a pair of opposing slots formed therein for receiving edges of a load terminal. The edges of the load terminal may each include a detent formed thereon for retaining the edges within the pair of opposing slots.

Another embodiment includes a lever having a first end disposed proximate an end of a bimetallic element and a second end disposed proximate an armature in the magnetic assembly of the trip unit. At least one of the bimetallic element and the armature rotate the trip lever to unlatch an operating mechanism. The lever and the bimetallic element may extend into the second compartment through an opening in the top of the housing.

BRIEF DESCRIPTION OF THE DRAWINGS

Referring to the drawings wherein like elements are numbered alike in the several Figures.

DETAILED DESCRIPTION OF THE INVENTION

Figure 1:
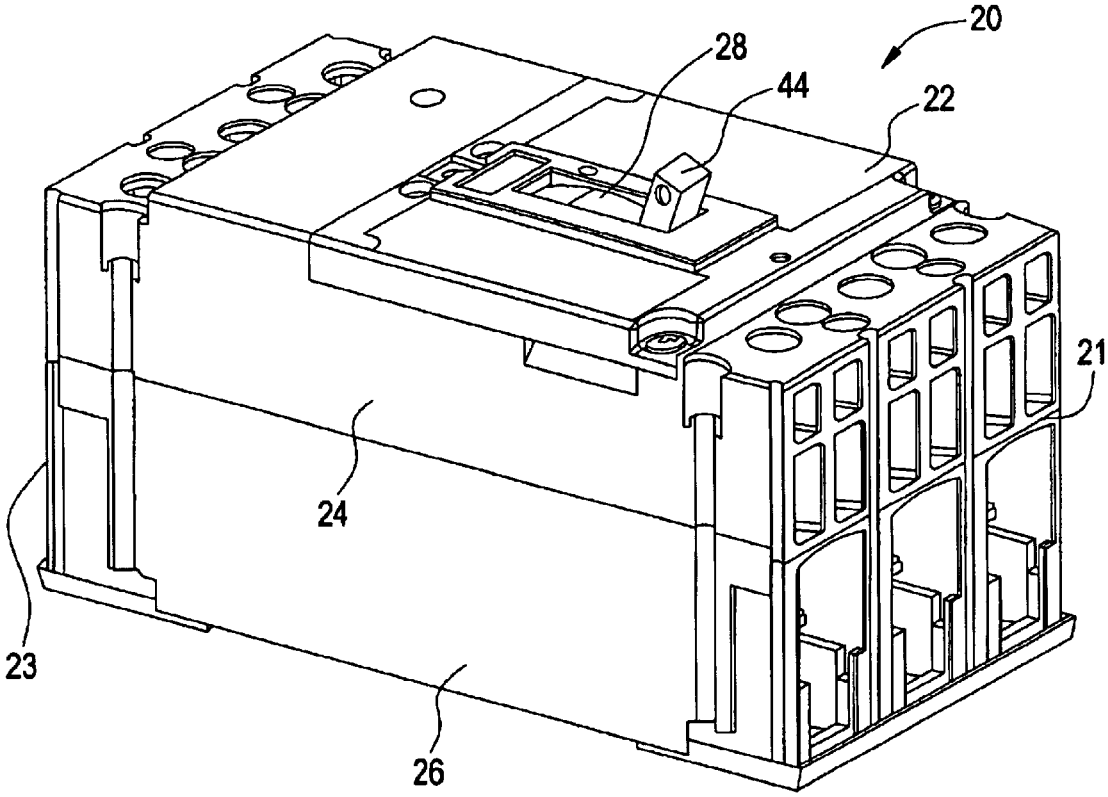
FIG. 1 is an isometric view of a molded case circuit breaker employing.

Referring to FIG. 1, a top perspective view of a molded case circuit breaker 20 is generally shown. Molded case circuit breaker 20 is generally interconnected within a protected circuit between multiple phases of a power source (not shown) at line end 21 and a load to be protected (not shown) at load end 23. Molded case circuit breaker 20 includes a base 26, a mid cover 24 and a top cover 22 having a toggle handle (operating handle) 44 extending through an opening 28.

Figure 2:
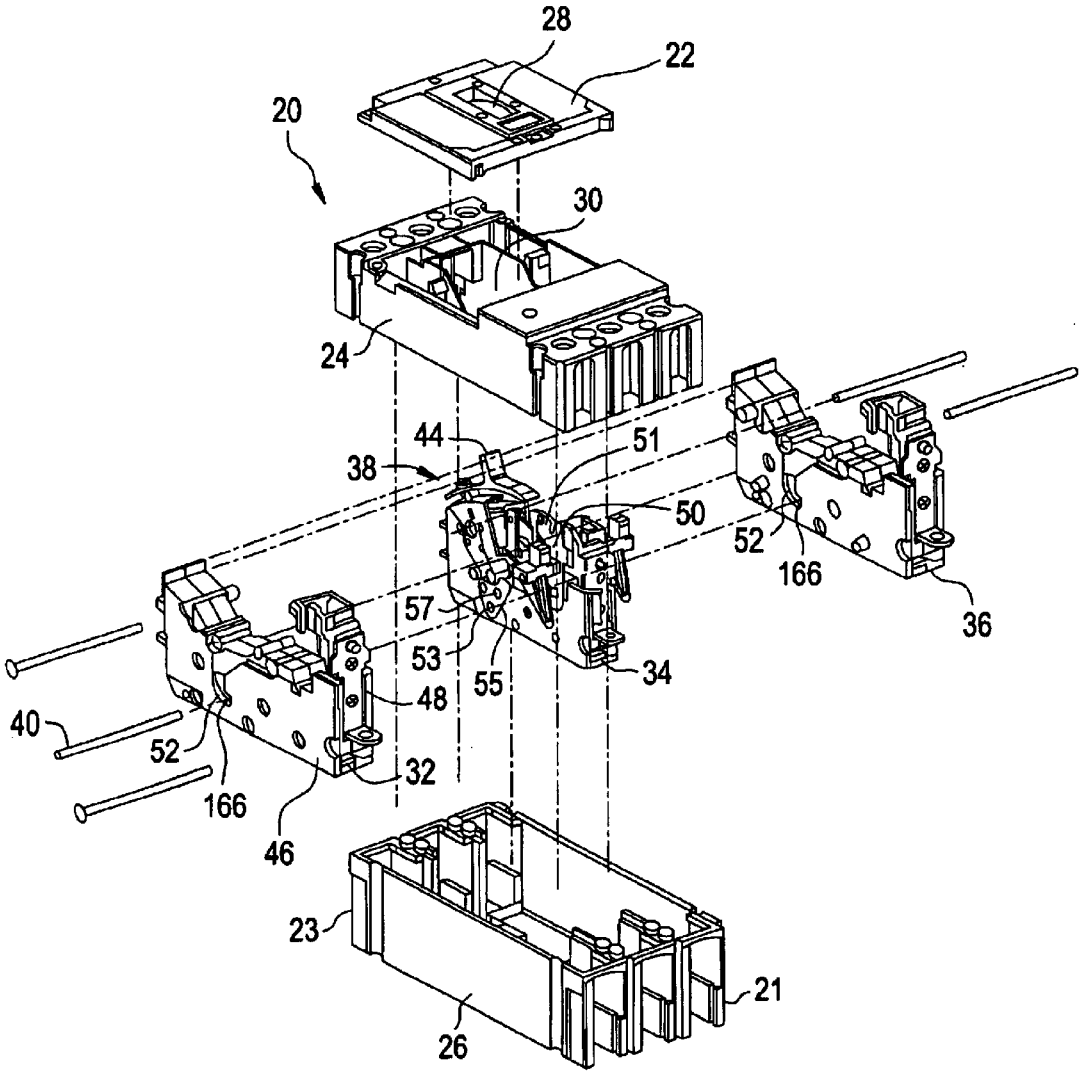
FIG. 2 is an exploded view of the circuit breaker of FIG. 1.

FIG. 2 shows an exploded view of the circuit breaker 20. Disposed within base 26 are a number of cassettes 32, 34, and 36, corresponding to the number of poles (phases of current) in the electrical distribution circuit into which circuit breaker 20 is to be installed. The example shown corresponds to a 3-pole system (i.e., three phases of current), and has three cassettes 32, 34 and 36 disposed within base 26. It is contemplated that the number of cassettes can vary corresponding to the number of phases. Cassettes 32, 34 and 36 are commonly operated by an operating mechanism 38 via a cross pin 40. Cassettes 32, 34, 36 are typically formed of high strength plastic thermoset material and each include opposing sidewalls 46, 48. Sidewalls 46, 48 have an arcuate slot 52 positioned and configured to receive and allow the motion of cross pin 40 by action of operating mechanism 38.

Operating mechanism 38 is shown positioned atop and supported by cassette 34, which is generally disposed intermediate to cassettes 32 and 36. It will be appreciated, however, that operating mechanism 38 may be positioned atop and supported by any number of cassettes 32, 34, and 36. Toggle handle 44 of operating mechanism 38 extends through openings 28 and 30 and allows for mating electrical contacts disposed within each of the cassettes to be separated and brought into contact by way of movement of toggle handle 44 between "open" and "closed" positions. Operating mechanism 38 also includes a trip latch system 50, which allows a spring mechanism 51 in the operating mechanism 38 to be unlatched (tripped) to separate the contacts in each of the cassettes 32, 34 and 36 by way of spring force applied to rotors in each of the cassettes 32, 34, and 36 via cross pin 40. More specifically, cross pin 40 extends through an aperture 53 in a plate 55 and through apertures 166 disposed in rotor assemblies 164 (see FIG. 6) in each of the cassettes 32, 34, and 36. Plate 55 is pivotally mounted to a fixed pivot point 57 and is linked to a spring in the operating mechanism 38. Unlatching the operating mechanism 38 releases the spring to apply a force to pivot the plate 55 about its pivot point 57. As the plate 55 pivots about pivot point 57, the plate 55 drives the rotors via the cross pin 40 to separate the contacts in each of the cassettes. The spring mechanism 51 may be reset to a latched position by operation of the toggle handle 44 to a "reset" position. Operating mechanism 38 may operate, for example, as described in U.S. Pat. No. 6,218,919 entitled "Circuit Breaker Latch Mechanism With Decreased Trip Time".

Figure 3:
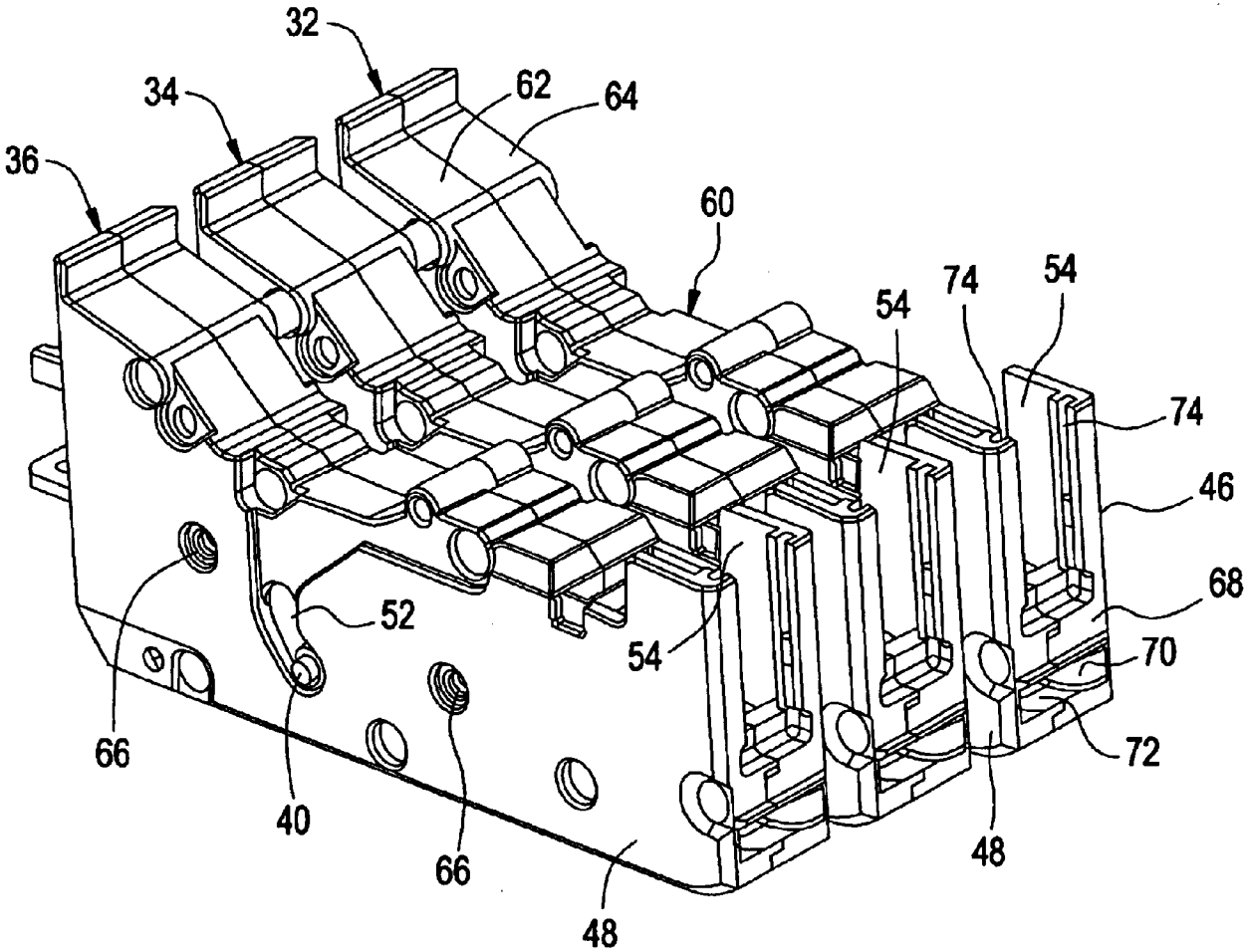
FIG. 3 is a perspective view of circuit breaker cassettes including a compartment for an integrated thermal and magnetic trip unit.

Referring now to FIG. 3, a perspective view of circuit breaker cassettes 32, 34, and 36 including compartments 54 for an integrated thermal and magnetic trip unit are shown. Each of the cassettes 32, 34, 26 include a housing 60 formed by two half-pieces 62, 64 joined by fasteners disposed through seven apertures 66 in the housing 60. A load-side end 68 of the housing 60 includes an outlet port 70 for an arc gas duct 72 formed in the housing 60. Disposed in the housing 60 above the outlet port 70 are a pair of opposing slots 74 that extend along an internal portion of sidewalls 46 and 48.

Figure 4:
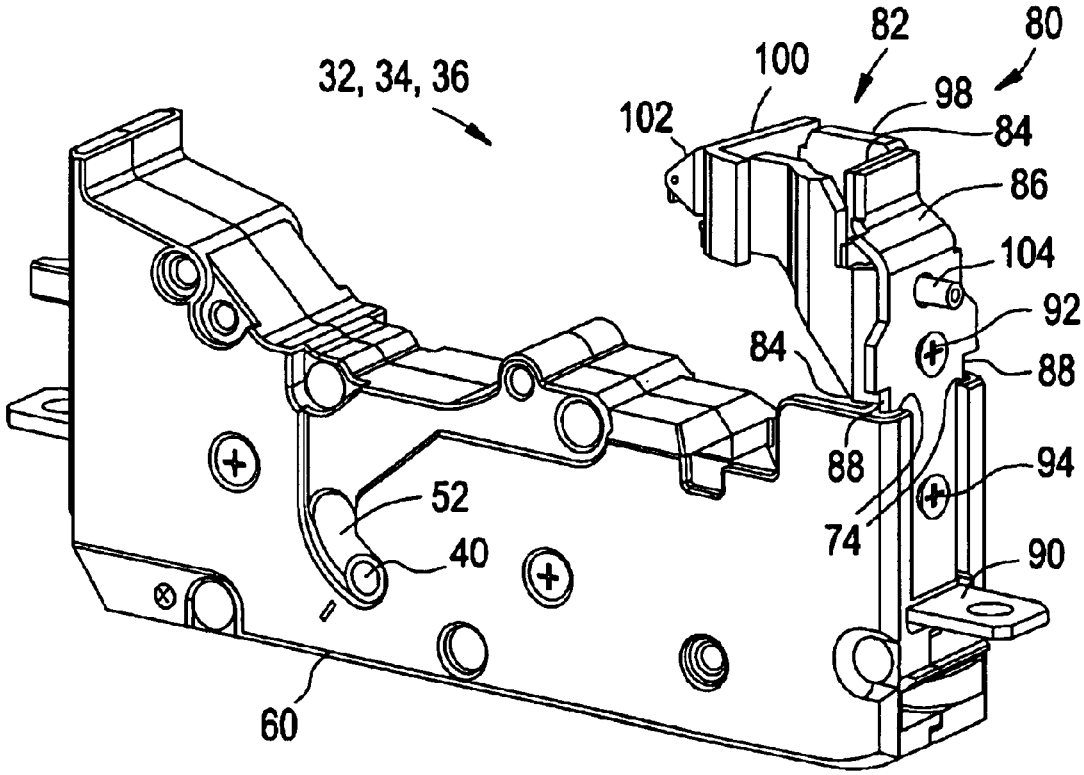
FIG. 4 is a perspective view of one of the circuit breaker cassettes including an integrated thermal and magnetic trip unit.

FIG. 4 is a perspective view of one of the circuit breaker cassettes 32, 34, or 36 supporting an integrated thermal and magnetic trip unit 80. Thermal and magnetic trip unit 80 includes a magnet assembly 82 and a bimetallic element 84 coupled to an end of a load terminal 86. Edges 88 of load terminal 86 are received within the opposing slots 74 formed in the housing 60 of the cassette 32, 34, or 36. A tab 90 extends from load terminal 86 for connection to wiring, a lug, or the like to form an electrical connection with the protected load. Fasteners 92, 94 secure the magnetic assembly 82 to the load terminal 86, and secure the load terminal 86 to a flux shunt 96 (shown in FIG. 6). Flux shunt 96 is a strip of magnetic material that extends along a length of the load terminal 86, between the load terminal 86 and the bimetallic element 84 to prevent electromagnetic forces developed by current flowing through the load terminal 86 and bimetallic element 84 from deflecting the bimetallic element 84.

Magnet assembly 82 includes a core 98 that extends around the bimetallic element 84, an armature 100 pivotally disposed on a leg 180 of the core 98, and a spring assembly 102 disposed on the armature 100. Spring assembly 102 acts to bias armature 100 away from a leg 188 of the core 98. A threaded set screw 104 extends through a hole in the load terminal 86 and a threaded hole in the core 98, and comes into contact with the bimetallic element 84. The set screw 104 is used for calibrating the bimetallic element 84. In some cases where a high resistance low amp bimetal is used, an insulator is inserted between the set screw 104 and bimetallic element 84 to prevent a parallel current path through the set screw 104 from damaging to the bimetal.

Figure 5:
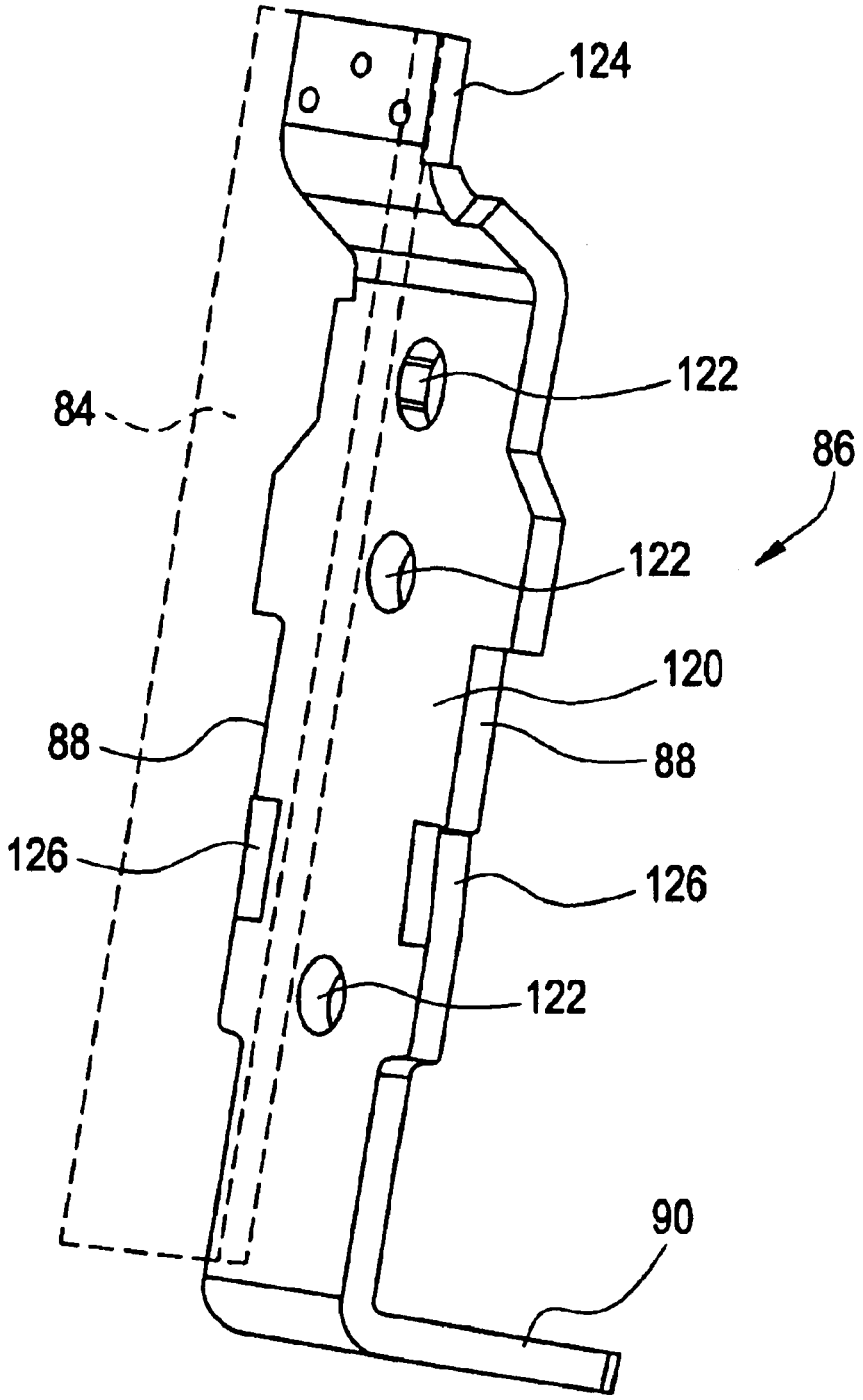
FIG. 5 is a perspective view of a load terminal of the circuit breaker cassette of FIG. 4.

FIG. 5 is a perspective view of the load terminal 86. Load terminal 86 includes a substantially flat portion 120 along which edges 88 are formed. Holes 122 disposed in the flat portion 120 receive fasteners 92, 94 and set screw 104 (FIG. 4). One end of the flat portion 120 includes the tab 90 extending substantially perpendicular therefrom, and an opposite end of the flat portion 120 is shaped to include an offset 124. The bimetallic element 84, shown in phantom, is attached to the load terminal 86 at the offset 124 using brazing, welding, fasteners, or the like. Each of the side edges 88 has a detent 126 formed thereon. The detent 126 provides an interference fit between the side edges 88 of the load terminal 86 and the slots 74 in the housing 60 to secure the side edges 88 within the slots 74 and thus prevent the load terminal 86 from deflecting under thermal stresses and mechanical loads. By preventing the load terminal 86 from deflecting and, thus, moving relative to the housing 60, movement of the thermal and magnetic trip unit 80, which is secured to the load terminal 86, will also be prevented. In the embodiment shown, detents 126 are stamped tabs formed in the flat portion.

Figure 6:
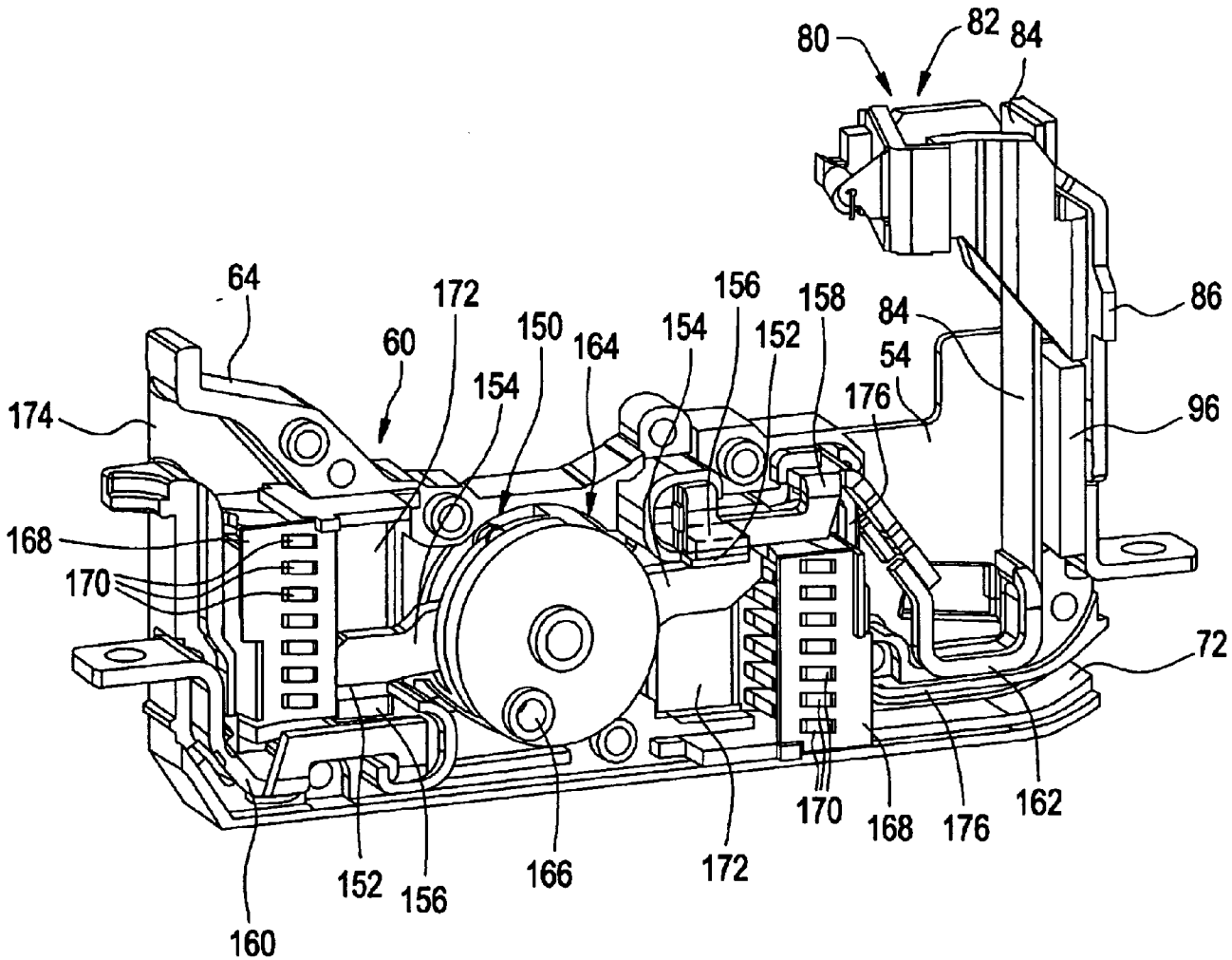
FIG. 6 is a partial cut-away view of the circuit breaker cassette including the integrated thermal and magnetic trip unit of FIG. 4.

Referring to FIG. 6, the cassette 32, 34, or 36 is shown with one half-piece 62 removed. Supported within cassette 32, 34, or 36 is a rotary contact assembly 150, which includes two mating pairs of electrical contacts, each pair having one contact 152 mounted on a contact arm 154 and another contact 156 mounted on one of a load strap 158 or a line strap 160. Load strap 158 is connected to a flexible braid 162, which is in turn coupled to an end of the bimetallic element 84. When the contacts 152, 156 are in a closed position (i.e., placed in intimate contact), electrical current passes between the line an load sides of the electrical distribution circuit through the line strap 160, the first pair of electrical contacts 152, 156, the contact arm 154, the second pair of electrical contacts 152, 156, the load strap 158, the flexible braid 162, the bimetallic element 84, and the load terminal 86.

The contact arm 154 is mounted within a rotor assembly 164, which is pivotally supported within the housing 60. A hole 166 in rotor assembly 164 accepts cross pin 40, which transmits the force of the operating mechanism 38 to pivot the rotor assembly 164 about its axis for separating the contacts 152, 156 to interrupt the flow of electrical current to the load terminal 86. The contact arm 154 may also pivot within the rotor assembly 164, thus allowing instantaneous separation of the contacts 152, 156 by the electromagnetic force generated in response to certain overcurrent conditions, such as dead short circuit conditions. The reverse loop shape of the line and load straps 158, 160 directs the electromagnetic force to separate the contacts 152, 156.

As the contacts 152, 156 move apart from each other to interrupt the flow of electrical current, an arc is formed between the contacts 152, 156, and the arc generates ionized gas. An arc arrestor 168 is supported in the housing proximate each pair of contacts 152, 156. The arc arrestor 168 includes a plurality of plates 170 disposed therein, which acts to attract, cool and de-ionize the arc to rapidly extinguish the arc. The gasses generated by the arc pass from a compartment 172 containing the contacts 152, 156, through the arc arrestor 168 and exhaust outside the housing 60 via ducts 72, 174. Duct 72 is formed adjacent to the compartment 54 for the integrated trip unit 80. A wall 176 extends inward from each of the sidewalls 46, 48 to form the duct 72 and to isolate the compartment 54 for the trip unit 80 from the compartment 172 including the contacts 152, 156. Other features that extend inward from each of the sidewalls 46, 48 include supports for the line and load straps 158, 160, support for the rotor assembly 164, and support for the arc arrestors 168.

Figure 7:
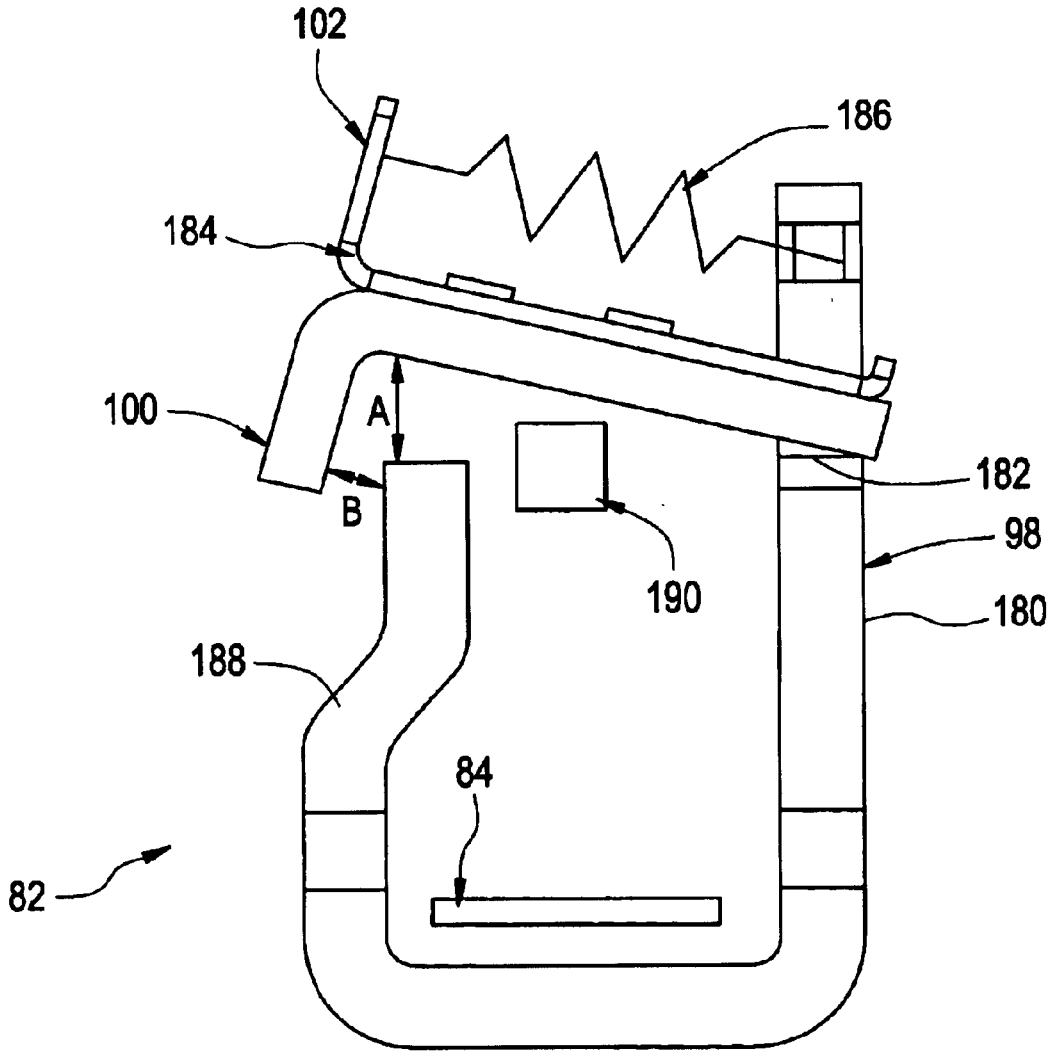
FIG. 7 is a plan view of a magnetic assembly for the thermal and magnetic trip unit.

Referring to FIG. 7, a plan view of the electro magnetic assembly 82 for the thermal and magnetic trip unit 80 is shown with the armature 100 in an open position. Armature 100 is generally L-shaped and is pivotally coupled to one leg 180 of the magnet core 98. The magnet core 98 is generally U-shaped and is disposed around the bimetallic element 84. A portion of armature 100 extends within an aperture 182 formed in the leg 180 of the magnet core 98 and is secured therein by an end of a bracket 184, which is fastened to the armature 100. A spring 186 extends between an opposite end of the bracket 184 and the leg 180 of the magnet core 98 to bias the armature 100 in the open position, away from another leg 188 of the magnet core 98.

As electrical current flows through the bimetallic element 84, a magnetic flux is created across gaps (A) and (B) which draws armature 100 toward the leg 188 of the magnet core 98. As the armature 100 moves toward the leg 188, it acts on a trip lever 190. When the current exceeds a predetermined amount (e.g., 12.5 times the breaker current rating), the magnetic force on the armature 100 overcomes the spring force 186, and the armature 100 pivots to move the trip lever 190.

The calibration screw adjusts the distance between the trip lever 190 and the bimetallic element 84 to set the distance of travel of the bimetal needed to move the trip lever 190.

Figure 8:
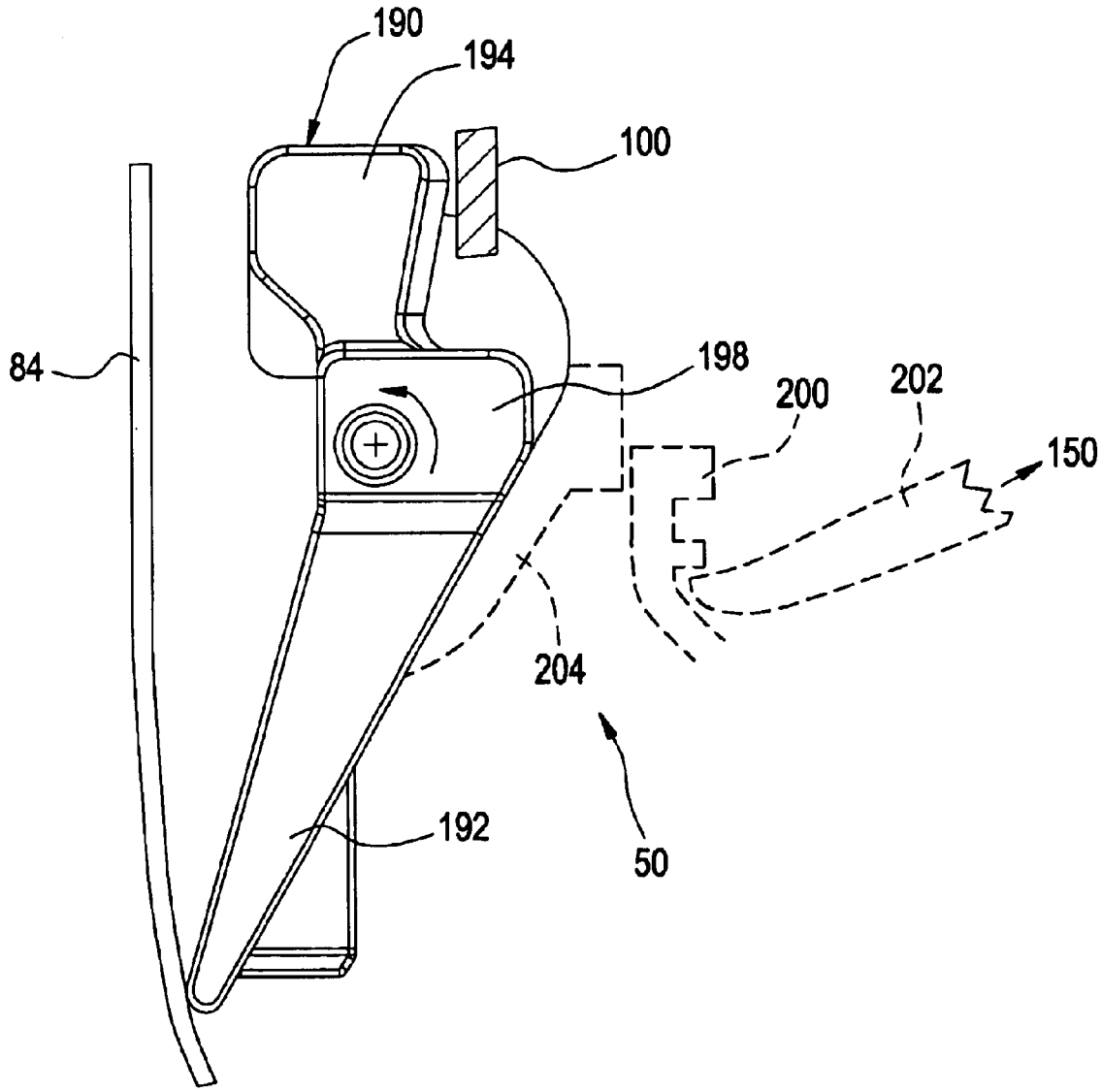
FIG. 8 is a schematic depiction of the thermal and magnetic trip unit and a trip lever of the operating mechanism.
Figure 9:
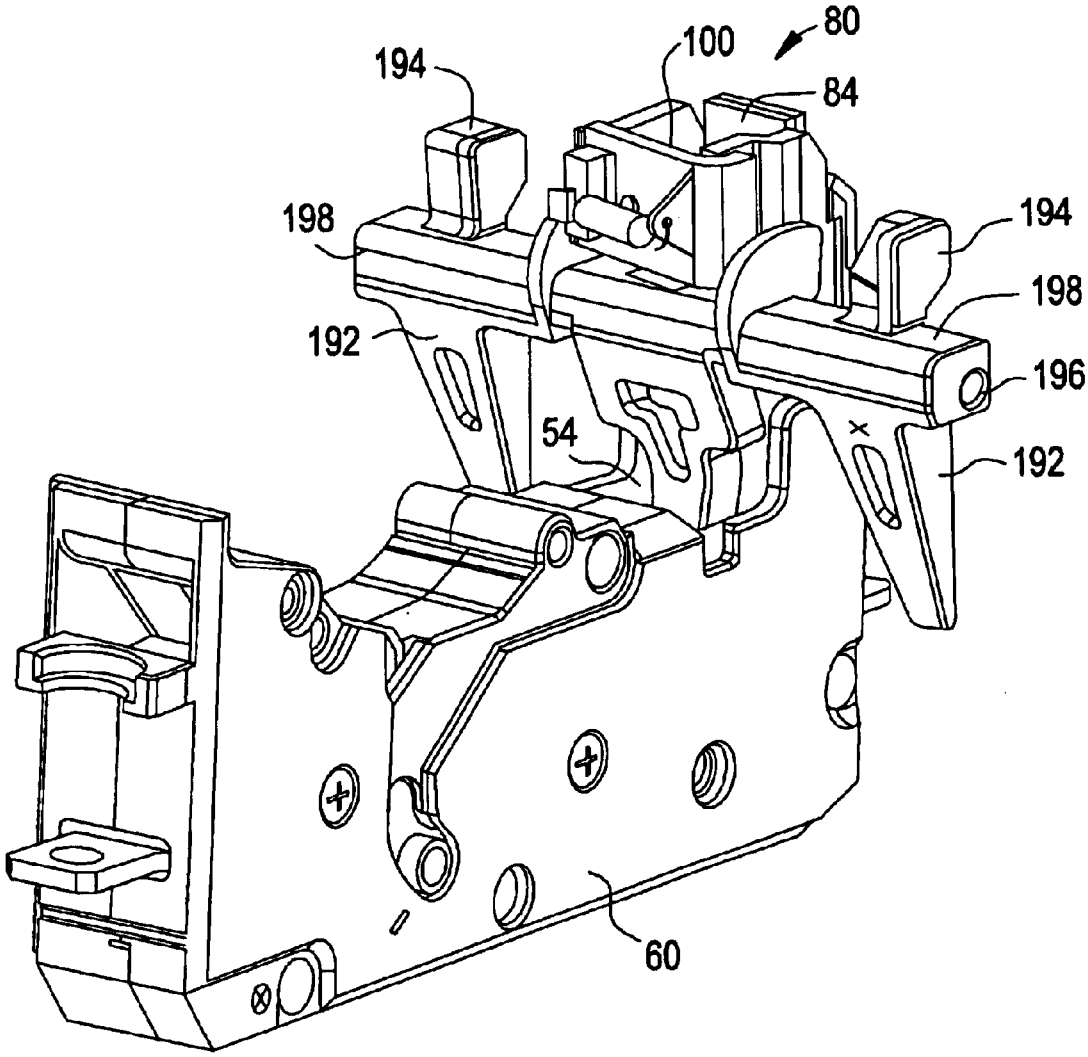
FIG. 9 is a perspective view of the trip lever positioned relative to a cassette housing.

FIG. 8 is a schematic depiction of the interaction between the thermal and magnetic trip unit 80 and the trip lever 190. FIG. 9 is a perspective view of the trip lever 190 positioned relative to a cassette housing 60. As shown in FIG. 8 and FIG. 9, trip lever 190 includes a first end 192 extending from a bar 198 and disposed proximate an end of the bimetallic element 84, and a second end 194 extending from bar 198 and disposed proximate the armature 100. The trip lever 190 and the bimetallic element 84 extend into the compartment 54 through an opening in the top of the housing 60. As discussed above, movement of the armature 100 in response to a predetermined amount of current in the bimetallic element 84 causes the armature 100 to move the trip lever 190. The trip lever 190 may also be moved by the bimetallic element 84 itself, which forms the thermal portion of the thermal and magnetic assembly 80. As current flows through the bimetallic element 84, the bimetallic element 84 heats up and bends due to the different coefficients of expansion in the metals used to form the bimetallic element 84. As the bimetallic element 84 bends due to increased temperature, it comes into contact and moves the trip lever 190.

Movement of the trip lever 190 by either the armature 100 or the bimetallic element 84 causes the trip lever 190 to rotate in the direction indicated by the arrow about a pivot point 196. Trip lever 190 may be coupled to the trip latch system 50 of the operating mechanism 38 using any suitable arrangement such that rotation of the trip lever 190 will cause the spring mechanism 51 to become unlatched to separate the contacts 152, 156. For example, the trip latch system 50 may operate as described in U.S. Pat. No. 6,218,919 entitled "Circuit Breaker Latch Mechanism With Decreased Trip Time" where trip latch system 50 would include a primary latch 200 releasably coupled to the operating mechanism 38 via a cradle 202 and biased against a secondary latch 204 affixed to trip lever 190 such that rotation of the trip lever 190 (in the direction indicated by the arrow) by either the bimetallic element 84 or armature 100 will cause the secondary latch 204 to pivot away from and out of contact with the primary trip latch 200. Without secondary latch 204 to restrain movement of the primary latch 200, the primary latch 200 moves to release the cradle 202 and, thus, unlatch the spring mechanism 51, which, in turn, separates the electrical contact pairs 152, 156 in each of the cassettes 32, 34, and 36. As best seen in FIG. 9, bar 198 includes a number of trip levers 190 disposed thereon equal to the number of cassettes 32, 34 and 36 in the circuit breaker 20. Thus, the movement of any trip lever 190 will cause rotation of the bar 198 about pivot point 196 to trip the circuit breaker 20.

Integrating the thermal and magnetic trip unit 80 with the cassette housing 60 provides many advantages over the prior art arrangement, in which the thermal and magnetic trip unit are mounted separately from the cassette in the base. First, integrating the trip unit 80 with the housing 60 allows for a reduction of parts, as a separate housing for the trip unit 80 is not needed. Second, integrating the trip unit 80 with the housing 60 provides for a more accurate alignment of the trip unit 80, operating mechanism 38, and cassette 32, 34 or 36 because the cassette 32, 34 or 36 is the common datum for both the operating mechanism 38 and the trip unit 80. Third, integrating the trip unit 80 with housing 60 allows for easy assembly, as the cassettes 32, 34 and 36, operating mechanism 38, and trip units 80 can be inserted into the base 26 as a unit. Finally, because the trip unit 80 is mounted in the thermoset material of the housing 60, which provides minimal deflection due to thermal heating and mechanical loading, the trip unit 80 remains aligned with the cassette 32, 34 or 36 and operating mechanism 38 under thermal heating and mechanical loading and, as a result, calibration of the trip unit 80 can be maintained under these conditions. The integrated trip unit 80 is supported in the most robust part of the breaker 20, thus making the trip unit 80 insensitive to mechanical forces on the load terminals during the attachment of cables so as to prevent changes to the calibration of the integrated trip unit 80.

The separation of compartments 54 and 172 ensures that the trip unit 80 is isolated from exposure to the hot arc gasses in the interrupter compartment 172. Without separate compartments 54 and 172, the hot arc gasses could result in damage to the bimetallic element 84 or braid 162, which could affect calibration. The hot arc gasses could also create deposits on the latch surfaces that may prevent unlatching of the trip latch system 50, or could result contamination causing dielectric breakdown between phases of opposite polarity.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A circuit breaker for a multi-pole electrical distribution circuit, the circuit breaker including:

a cassette associated with each pole in the multi-pole electrical distribution circuit, each cassette including:

a housing, a pair of electrical contacts disposed in the housing, and a thermal and magnetic trip unit supported by the housing, the thermal and magnetic trip unit initiates separation of the pair of electrical contacts in response to an overcurrent condition in the multi-pole electrical distribution circuit.

2. The circuit breaker of claim 1, wherein the housing includes:

a first compartment having the pair of electrical contacts disposed therein; and a second compartment having at least a portion of the thermal and magnetic trip unit disposed therein, the first and second compartments having a wall disposed therebetween for isolating the second compartment from gasses generated by separation of the pair of electrical contacts.

3. The circuit breaker of claim 2, wherein the first compartment is in fluid communication with an exterior portion of the housing through a duct adjacent the second compartment, the gasses generated by separation of the pair of electrical contacts pass through the duct to the exterior portion of the housing.

4. The circuit breaker of claim 1, wherein the housing is formed from a thermoset material.

5. The circuit breaker of claim 1, wherein an end of the housing includes a pair of opposing slots formed therein for receiving edges of a load terminal.

6. The circuit breaker of claim 5, wherein the edges of the load terminal each include a detent formed thereon for retaining the edges within the pair of opposing slots.

7. The circuit breaker of claim 1, wherein the thermal and magnetic trip unit includes:

a bimetallic element electrically coupled to at least one of the electrical contacts;

a core disposed proximate the bimetallic element, and an armature disposed proximate the core, wherein movement of at least one of the bimetallic element and the armature initiates separation of the pair of electrical contacts.

8. The circuit breaker of claim 7, further comprising:

an operating mechanism operably coupled to at least one of the electrical contacts, the operating mechanism separating the pair of electrical contacts in response to being unlatched; and a lever having a first end disposed proximate an end of the bimetallic element, a second end disposed proximate the armature, and wherein at least one of the bimetallic element and the armature rotate the lever to unlatch the operating mechanism.

9. The circuit breaker of claim 8, wherein the housing includes:

a first compartment having the pair of electrical contacts disposed therein; and a second compartment having at least a portion of the thermal and magnetic trip unit disposed therein, the first and second compartments having a wall disposed therebetween for isolating the second compartment from gasses generated by separation of the pair of electrical contacts, the lever and the bimetallic element extend into the second compartment through an opening in the top of the housing.

10. A circuit breaker including:

a base;

a plurality of cassettes disposed in the base, each cassette including:

a housing, a pair of electrical contacts disposed in the housing, a load terminal electrically coupled to a first contact in the pair of electrical contacts, the load terminal supported by the housing, and a thermal and magnetic trip unit supported by the housing; and an operating mechanism operably coupled to a second contact in the pair of electrical contacts, wherein the thermal and magnetic trip unit unlatches the operating mechanism in response to a level of current flowing through the pair of electrical contacts, and the operating mechanism separates the first and second contacts in response to being unlatched by the thermal and magnetic trip unit.

11. The circuit breaker of claim 10, wherein the housing of at least one cassette supports the operating mechanism.

12. The circuit breaker of claim 10, wherein the housing includes:

a first compartment having the pair of electrical contacts disposed therein; and a second compartment having at least a portion of the thermal and magnetic trip unit disposed therein, the first and second compartments having a wall disposed therebetween for isolating the second compartment from gasses generated by separation of the first and second contacts.

13. The circuit breaker of claim 12, wherein the first compartment is in fluid communication with an exterior portion of the housing through a duct adjacent the second compartment, the gasses generated by separation of the first and second contacts pass through the duct to the exterior portion of the housing.

14. The circuit breaker of claim 10, wherein the housing is formed from a thermoset material.

15. The circuit breaker of claim 10, wherein an end of the housing includes a pair of opposing slots formed therein for receiving edges of the load terminal.

16. The circuit breaker of claim 15, wherein the edges of the load terminal each include a detent formed thereon for retaining the edges within the pair of opposing slots.

17. The circuit breaker of claim 10, wherein the thermal and magnetic trip unit includes:

a bimetallic element electrically coupled to the first contact;

a core disposed proximate the bimetallic element; and an armature disposed proximate the core, wherein movement of at least one of the bimetallic element and the armature initiates separation of the pair of electrical contacts.

18. The circuit breaker of claim 17, wherein the operating mechanism includes a lever having a first end disposed proximate an end of the bimetallic element, a second end disposed proximate the armature, and wherein at least one of the bimetallic element and the armature rotate the lever to unlatch the operating mechanism.

19. The circuit breaker of claim 18, wherein the housing includes:

a first compartment having the pair of electrical contacts disposed therein; and a second compartment having at least a portion of the thermal and magnetic trip unit disposed therein, the first and second compartments having a wall disposed therebetween for isolating the second compartment from gasses generated by separation of the first and second contacts, the lever and the bimetallic element extend into the second compartment through an opening in the top of the housing.

* * * * *